US009200764B2

(12) United States Patent
Yang et al.

(10) Patent No.: US 9,200,764 B2
(45) Date of Patent: Dec. 1, 2015

(54) LIGHT EMITTING DIODE LAMP

(71) Applicant: ADVANCED OPTOELECTRONIC TECHNOLOGY, INC., Hsinchu Hsien (TW)

(72) Inventors: Min-Shun Yang, Hsinchu (TW); Ming-Ta Tsai, Hsinchu (TW); Hao-Xiang Lin, Hsinchu (TW)

(73) Assignee: ADVANCED OPTOELECTRONIC TECHNOLOGY, INC., Hsinchu Hsien (TW)

( * ) Notice: Subject to any disclaimer, the term of this patent is extended or adjusted under 35 U.S.C. 154(b) by 0 days.

(21) Appl. No.: 14/449,580

(22) Filed: Aug. 1, 2014

(65) Prior Publication Data

US 2015/0036342 A1 Feb. 5, 2015

(30) Foreign Application Priority Data

Aug. 5, 2013 (CN) ..... 2013 1 03365154

(51) Int. Cl.
*F21V 7/00* (2006.01)
*F21K 99/00* (2010.01)
*F21Y 101/02* (2006.01)

(52) U.S. Cl.
CPC ... *F21K 9/50* (2013.01); *F21K 9/30* (2013.01); *F21V 7/0016* (2013.01); *F21V 7/0066* (2013.01); *F21Y 2101/02* (2013.01)

(58) Field of Classification Search
CPC ..... F21V 7/0025; F21V 7/005; F21V 7/0083; F21V 7/048; F21V 7/00–7/022; F21K 9/10; F21K 9/135; F21K 9/137; F21K 9/50; F21K 9/30; F21Y 2101/02
USPC ..... 313/46, 113, 512, 111; 362/241, 243, 362/245, 247, 296.01, 297, 296.05, 311.02, 362/341, 346, 800, 555, 514, 516–518, 301
See application file for complete search history.

(56) References Cited

U.S. PATENT DOCUMENTS

| | | | | |
|---|---|---|---|---|
| 6,464,373 | B1 | 10/2002 | Petrick et al. | |
| 8,287,147 | B2 * | 10/2012 | Tian et al. | 362/244 |
| 8,297,797 | B2 * | 10/2012 | Kim et al. | 362/294 |
| 8,427,037 | B2 * | 4/2013 | Liang et al. | 313/113 |
| 8,646,942 | B2 * | 2/2014 | Boomgaarden et al. | 362/249.02 |
| 8,704,432 | B2 * | 4/2014 | Jin | 313/46 |
| 8,807,792 | B2 * | 8/2014 | Cho et al. | 362/247 |

(Continued)

FOREIGN PATENT DOCUMENTS

| | | | |
|---|---|---|---|
| JP | 2011100709 | A | 5/2011 |
| JP | 2012094320 | A | 5/2012 |
| WO | 2012095905 | A1 | 7/2012 |
| WO | 2013046294 | A1 | 4/2013 |

*Primary Examiner* — Anne Hines
*Assistant Examiner* — Jose M Diaz
(74) *Attorney, Agent, or Firm* — Novak Druce Connolly Bove + Quigg LLP

(57) ABSTRACT

A light emitting diode (LED) lamp includes a substrate, a plurality of LED elements arranged on the substrate, and a reflector arranged on the substrate. The reflector includes a plurality of reflecting sheets obliquely extending upward and outward from a center of the substrate. A projection of each of the reflecting sheets covers one LED element. Each of the reflecting sheets corresponding to the LED element defines a perforation. Part of light from the LED element directly radiates out via the perforation, and part of light from the LED package is reflected to a lateral periphery of the substrate by the reflecting sheet.

13 Claims, 5 Drawing Sheets

(56) References Cited

U.S. PATENT DOCUMENTS

2011/0215345 A1* 9/2011 Tarsa et al. ..... 257/88
2012/0273812 A1* 11/2012 Takahashi et al. ..... 257/88
2013/0039056 A1* 2/2013 Cho et al. ..... 362/235
2013/0128570 A1 5/2013 Jiang et al.
2013/0214666 A1* 8/2013 Leung et al. ..... 313/46
2013/0242566 A1* 9/2013 Kim ..... 362/308
2013/0271991 A1* 10/2013 Hussell et al. ..... 362/249.02

* cited by examiner

LIGHT EMITTING DIODE LAMP

CROSS-REFERENCE TO RELATED APPLICATIONS

This patent application is a related application of U.S. patent application Ser. No. 14/449,591 filed on Aug. 01, 2014, entitled "LIGHT EMITTING DIODE LAMP", assigned to the same assignee.

FIELD

The disclosure relates to semiconductor emitting device, and more particularly to a light emitting diode (LED) lamp.

BACKGROUND

LEDs have low power consumption, high efficiency, quick reaction time, long lifetime, and the absence of toxic elements such as mercury during manufacturing. Due to those advantages, traditional light sources are gradually replaced by LEDs.

A conventional LED lamp includes a substrate and a plurality of LEDs arranged on the substrate. The LEDs are usually densely arranged in array on the top surface of the substrate. However, the conventional LED generally generates a smooth round light field with a radiation angle of 90 degrees (−45 degrees to 45 degrees), wherein the light at a center of the conventional LED (i.e., 0 degree) is relatively great and the light at a periphery of the conventional LED is relatively poor. Such that, light emitted by the LED lamp including the conventional LEDs densely arranged on the substrate has a small radiation angle and is unevenly distributed, and thereby a whole light output of the LED lamp is barely satisfactory for illumination.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the present LED lamp. Moreover, in the drawings, all the views are schematic, and like reference numerals designate corresponding parts throughout the views.

DETAILED DESCRIPTION

Figure 1:
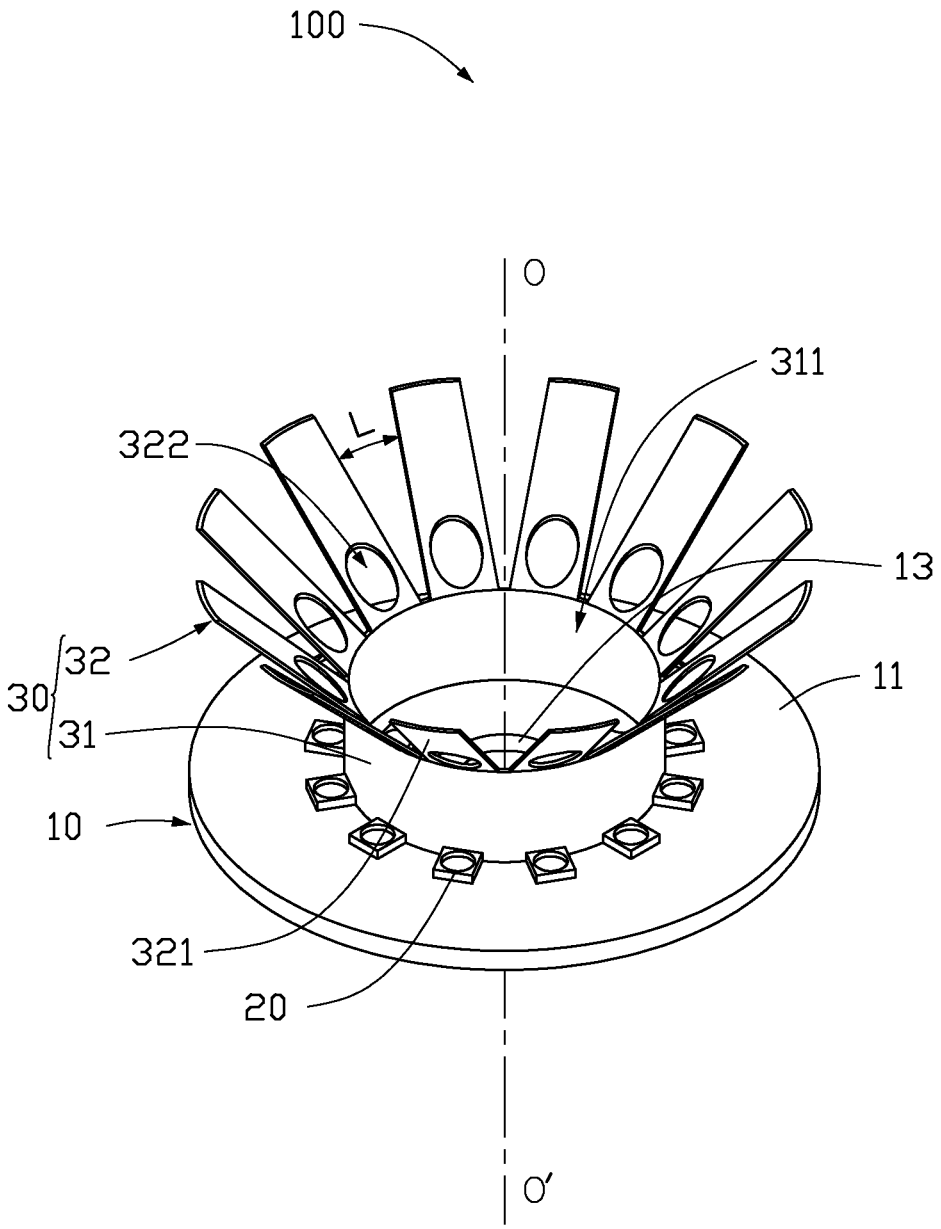
FIG. 1 is an isometric view of an LED lamp in accordance with a first exemplary embodiment of the present disclosure.
Figure 2:
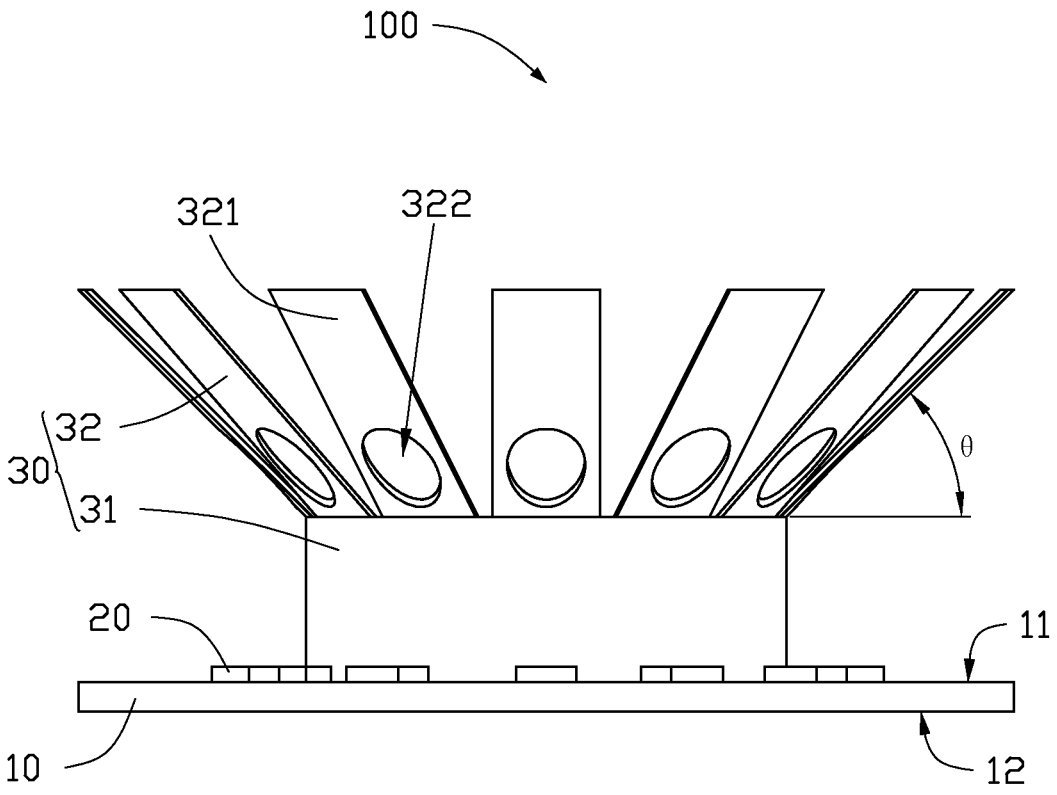
FIG. 2 is a side view of the LED lamp of FIG. 1.

Referring to FIGS. 1 and 2, an LED lamp 100 in accordance with a first embodiment is provided. The LED lamp 100 includes a substrate 10, a plurality of LED elements 20 arranged on the substrate 10 and a reflector 30 arranged on the substrate 10.

Specifically, the substrate 10 is annular but not limited to be annular. The substrate 10 includes a top surface 11 and a bottom surface 12 opposite to the top surface 11. A through hole 13 is defined at a center of the substrate 10, the through hole 13 penetrates the top surface 11 and the bottom surface 12 for fixing the LED lamp 100 by engaging with other components (not shown). The top surface 11 of the substrate 10 is provided with circuit lines (not shown) electrically connecting with the LED elements 20. In this embodiment, the substrate 10 is a printed circuit board. Alternatively, the substrate 10 could also be ceramic substrate or Aluminum substrate for better cooling effects.

The LED elements 20 are arranged on the top surface 11 of the substrate 10 and located at a lateral periphery of the through hole 13. In this embodiment, the LED elements 20 are annularly arranged in a circle. Alternatively, an arranging shape of the LED elements 20 could be adjusted according to actual light radiating requirements, such as triangle, square and so on. Each of the LED elements 20 is an LED package, and the LED package could be coupled with phosphor to change a color of the light radiating from the LED package.

The reflector 30 includes a cylindrical connector 31 and a plurality of flat reflecting sheets 32 obliquely extending upward from the connector 31. In this embodiment, the reflector 30 is made of plastic materials by injecting molding. Alternatively, the reflector 30 could also be constructed of metal by means of compression molding.

In at least one embodiment, the connector 31 is a cylindrical sheet. The connector 31 vertically extends upward from the top surface 11 of the substrate 10. Alternatively, the connector 31 could also obliquely extend upward from the substrate 10. The connector 31 surrounds the through hole 13. The LED elements 20 surround the connector 31. Preferably, the LED elements 20 resist an outer surface of the connector 30 for increasing a reflection of the light radiating from the LED elements 20.

The reflecting sheets 32 obliquely extend upward and outward from a top end of the connector 31. The reflecting sheets 32 and the connector 31 are integrally formed as a single piece. A free end of each of the reflecting sheets 32 is located right above the lateral periphery of the substrate 10. The reflecting sheets 32 are symmetrically arranged relative to an axis $O\text{-}O_1$ of the connector 31. The axis $O\text{-}O_1$ is superposed with that of the through hole 13 of the substrate 10.

Each of the reflecting sheets 32 is a longitudinal flat sheet with a constant width. A space L is defined between two adjacent reflecting sheets 32, and a dimension of the space L is gradually increased along an extending direction of the reflecting sheets 32 from the connector 31. A number of the reflecting sheets 32 is equal to that of the LED elements 20 in this embodiment. Each of the reflecting sheets 32 correspondingly covers one LED element 20, that is a projection of each of the reflecting sheets 32 on the substrate 10 correspondingly covers one LED element 20. The reflecting sheets 32 have a larger area than the LED elements 20, and the projection of each reflecting sheet 32 completely covers the corresponding LED element 20 and extends beyond a periphery of the corresponding LED element 20.

Each of the reflecting sheets 32 includes a reflecting surface 321 facing to the corresponding LED element 20. The reflecting surface 321 is flat and reflects part of light emitted by the LED element 20 to the lateral periphery of the substrate 10, and thereby a radiation angle of the LED lamp 100 is increased. An angle θ is defined between the reflecting surface 321 and a horizontal surface where the top end of the connector 31 (and of course the substrate 10) is located at. The angle θ ranges from 25 degrees to 45 degrees, that is the angle between the reflecting surface 321 and the horizontal surface parallel to the substrate 10 ranges from 25 degrees to 45 degrees.

One end of each of the reflecting sheets 32 adjacent to the connector 31 defines a perforation 322 corresponds the LED element 20 covered by the reflecting sheet 32, that is each of the perforations 322 is located right above the LED element 20. In this embodiment, a dimension of the perforation 322 is equal to that of the corresponding LED element 20. Alternatively, the dimension of the perforation 322 could also be smaller than that of the LED element 20 covered by the reflecting sheet 32.

During the operation of the LED lamp 100, part of light emitted by the LED element 20 near to a center of the radiation angle directly radiates upward and out via the perforation 322. Simultaneously, part of light bias from the center of the radiation angle directly radiates upward and out via the space L between each two adjacent reflecting sheets 32, and part of light are reflected to the lateral periphery of the substrate 10 by the outer surface of the connector 31 and the reflecting surface 321 of the reflecting sheet 32.

Figure 3:
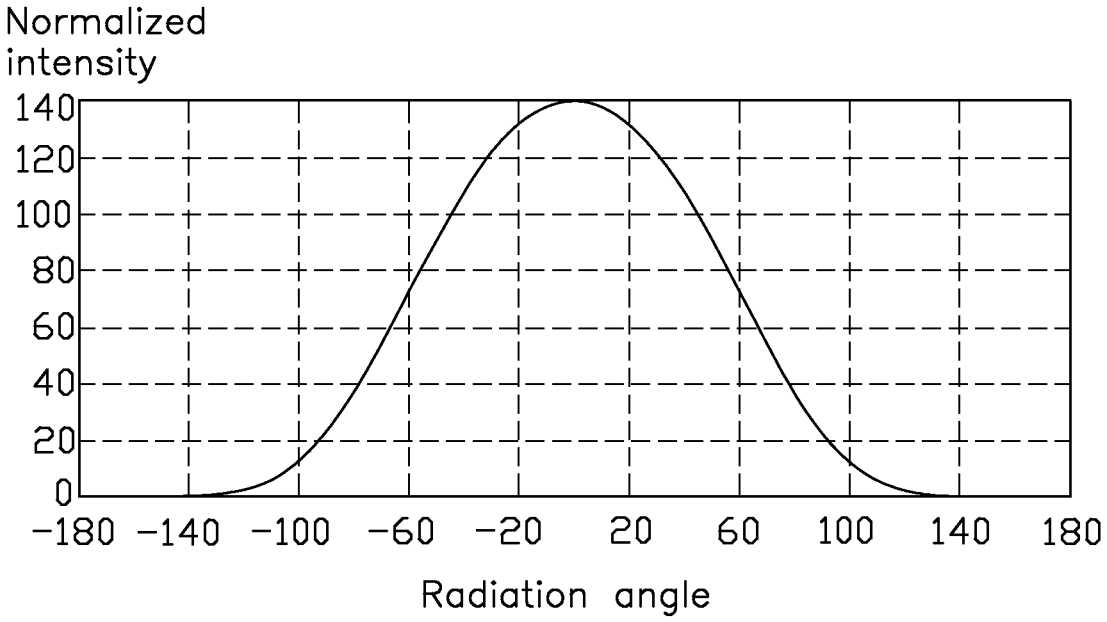
FIG. 3 (PRIOR ART)
FIG. 3 is a schematic view showing a light distribution curve of a traditional LED lamp.
Figure 4:
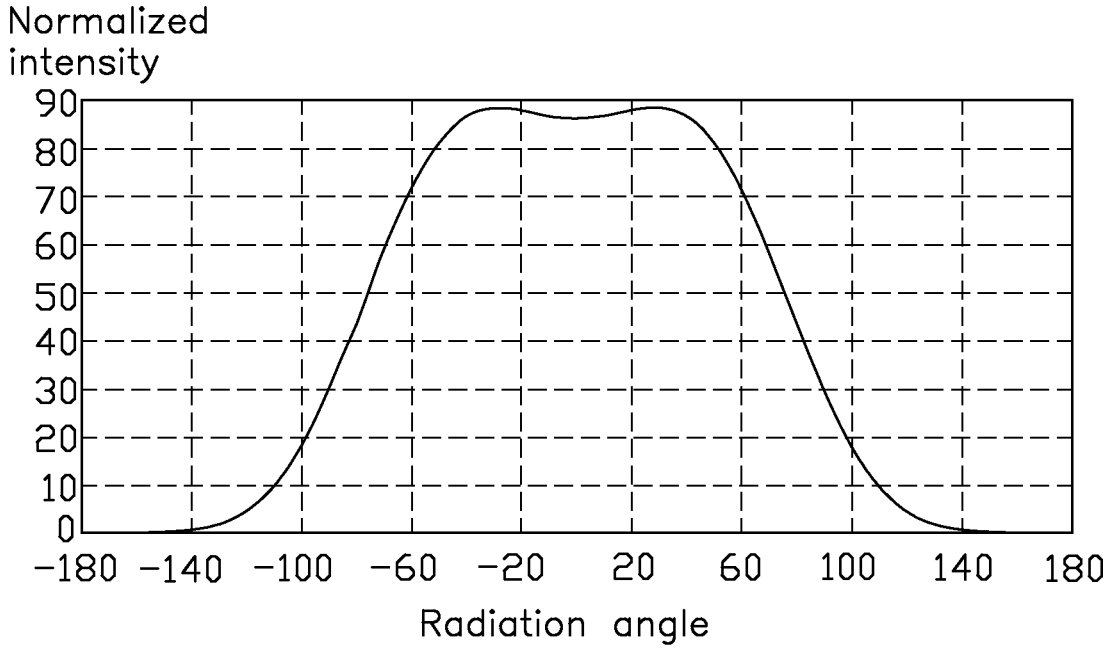
FIG. 4 is a schematic view showing a light distribution curve of the LED lamp of FIG. 1.

FIGS. 3 and 4 illustrate a comparison between a traditional LED lamp and the LED lamp provided by the present disclosure. FIG. 3 shows a light distribution curve of the traditional LED lamp (without reflector), FIG. 4 shows a light distribution curve of the LED lamp 100, wherein the angle θ is 45 degrees. In FIG. 3 and FIG. 4, the horizontal axis represents the light radiation angle (in degree), and the vertical axis represents normalized intensity. Compared to the light distribution of the traditional lamp, a half-power angle (a light radiation angle corresponding to a half light intensity of the highest light intensity) is changed to 156 degrees from 120 degrees, such that the light radiation angle of the LED lamp 100 is increased, and thereby a light radiation filed of the LED lamp 100 is correspondingly increased. In addition, a light brightness of the LED lamp 100 at a center thereof is substantially equal to a light brightness of the LED lamp 100 at a periphery thereof, such that the light radiating from the LED lamp 100 is evenly distributed.

Since the LED lamp 100 of present disclosure includes a reflector 30 corresponding to the plurality of LED elements 20, the reflecting sheets 32 of the reflector 30 each covers one LED element 20 and reflects part of light emitted by the LED element 20 to the lateral periphery of the substrate 10. Therefore, the light radiation angle of the LED lamp 100 is increased. In addition, since part of light emitted by the LED element 20 directly radiates out via the perforation 322, which leads to the light brightness of the LED lamp 100 at a center thereof is substantially equal to a light brightness of the LED lamp 100 at a periphery thereof, such that the light radiating from the LED lamp 100 is evenly distributed.

Alternatively, the angle θ is not limited to 45 degrees. Referring to sheet 1 as below, the specific data shows relationships between the angle θ and the half-power angle of the LED lamp 100. When the angle θ gradually decreases, the half-power angle of the LED lamp 100 gradually increases. The angle θ ranges from 25 degrees to 45 degrees for keeping balance between the light radiation angle and the light intensity of the LED lamp 100.

| sheet 1 | | | | | |
|---|---|---|---|---|---|
| reflector angle θ | 45° | 40° | 35° | 30° | 25° |
| half-power angle | 156° | 160° | 162° | 164° | 165° |

Alternatively, the quantity of the reflecting sheets 32 may not be equal to that of the LED elements 20. In at least one embodiment, a plurality of annularly arranged groups of LED elements 20 could also be arranged on the substrate 10, that is one reflecting sheet 32 correspondingly cover several LED elements 20. Alternatively, the reflector 30 could also not comprise the connector 31, that is the reflecting sheets 32 are directly arranged on the substrate 10 and extend upward and outward.

Figure 5:
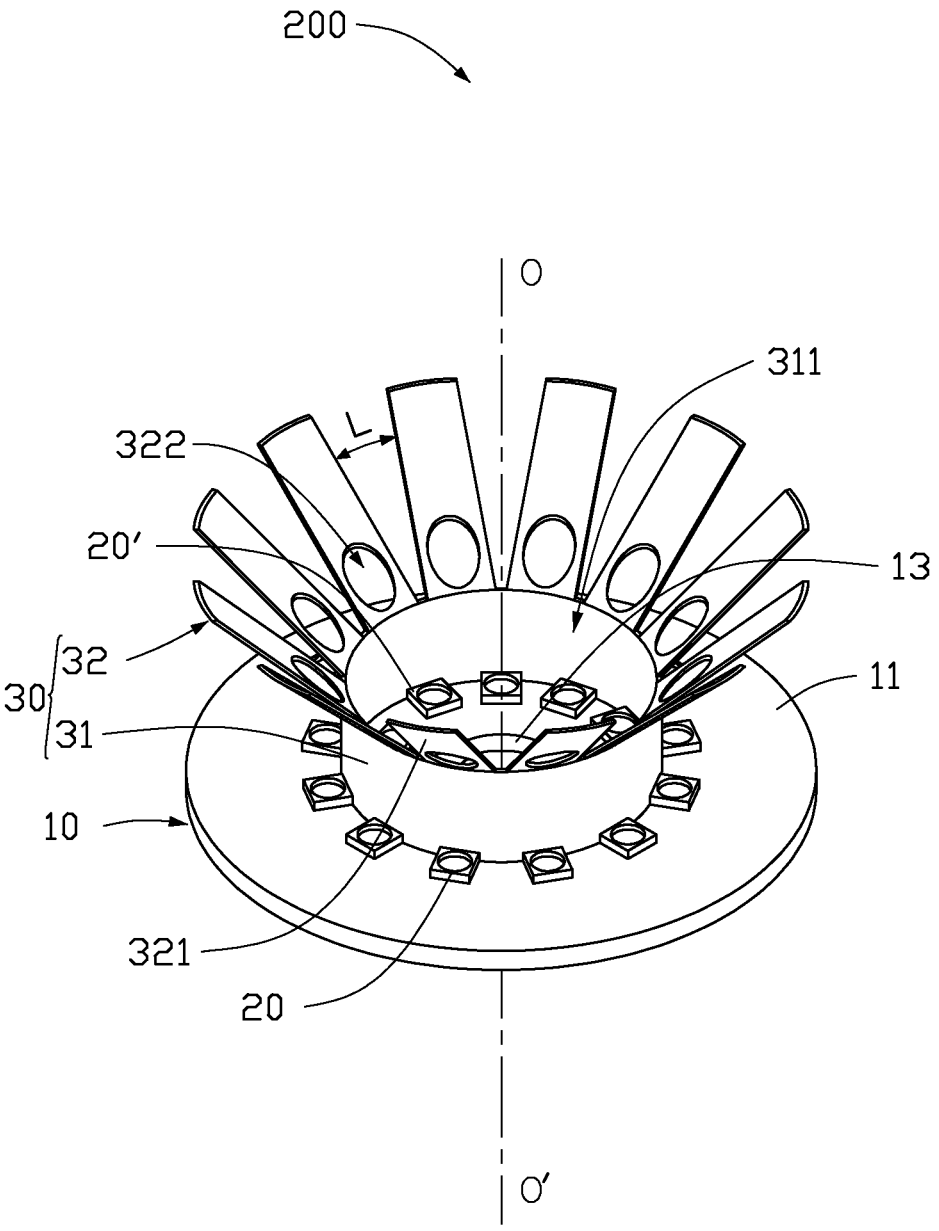
FIG. 5 is an isometric view of an LED lamp in accordance with a second exemplary embodiment of the present disclosure.

Referring to FIG. 5, an LED lamp 200 in accordance with a second embodiment is provided. The LED lamp 200 is similar to the LED lamp 100, the difference is that the connector 31 and part of the top surface 11 of the substrate 10 surrounded by the connector 31 are engaged together to form a receiving portion 311, and a plurality of assistant LED elements 20' are arranged on the top surface 11 of the substrate 10 surrounded by the connector 31. In other words, the assistant LED elements 20' are received in the receiving portion 311. The LED elements 20 and the assistant LED elements 20 are separated from each other by the connector 31, and the assistant LED elements 20' surround the through hole 13. Preferably, the assistant LED elements 20' received in the receiving portion 311 resist an inner surface of the connector 31.

It is to be understood that the above-described embodiments are intended to illustrate rather than limit the disclosure. Variations may be made to the embodiments without departing from the spirit of the disclosure. The above-described embodiments illustrate the scope of the disclosure but do not restrict the scope of the disclosure and do not limit the scope of the following claims.

What is claimed is:

1. A light emitting diode (LED) lamp, comprising:

a substrate;

a plurality of LED elements arranged on the substrate;

a reflector arranged on the substrate, the reflector comprising a plurality of reflecting sheets obliquely extending upward and outward from a center of the substrate, a projection of each of the reflecting sheets covering one LED element, each of the reflecting sheets defining a perforation corresponding to the LED element, part of light emitted by the LED element directly radiating out via the perforation, and part of light emitted by the LED element being reflected to a lateral periphery of the substrate.

2. The LED lamp of claim 1, wherein each of the reflecting sheets is a longitudinal flat plate and comprising a reflecting surface facing to the corresponding LED element, and the reflecting surface is a flat obliquely extending upward and outward.

3. The LED lamp of claim 2, wherein an angle between the reflecting surface and a horizontal surface parallel to the substrate ranges from 25 degrees to 45 degrees.

4. The LED lamp of claim 1, wherein a space is defined between each two adjacent reflecting sheets, and a width of the space gradually increases along an extending direction of the reflecting sheets.

5. The LED lamp of claim 1, wherein the reflector further comprises a cylindrical connector, the connector extending upward from the center of the substrate, the reflecting sheets obliquely extending upward and outward from a top end of the connector, and the perforations each being located one end of the reflecting sheet adjacent to the connector.

6. The LED lamp of claim 5, wherein the connector and part of the substrate surrounded by the connector are engaged together to form a receiving portion, and the LED lamp further comprises a plurality of assistant LED elements being received in the receiving portion.

7. The LED lamp of claim 6, wherein the LED elements covered by the reflecting sheets and the assistant LED elements are separated from each other by the connector, the LED elements being located at a lateral periphery of the connector.

8. The LED lamp of claim 7, wherein the LED elements resists an outer surface of the connector.

9. The LED lamp of claim 6, wherein the substrate defines a through hole at a center thereof, the assistant LED elements surrounding the through hole and resisting an inner surface of the connector.

10. The LED lamp of claim 1, wherein a dimension of each of the perforations is equal to that of the corresponding LED element covered by the reflecting sheet.

11. The LED lamp of claim 1, wherein the reflector is made of plastic materials by injecting molding.

12. The LED lamp of claim 1, wherein the reflector is made of metal by compression molding.

13. The LED lamp of claim 1, wherein free ends of the reflecting sheets are located right above the lateral periphery of the substrate.

* * * * *